US008544433B2

(12) United States Patent
Noguchi et al.

(10) Patent No.: US 8,544,433 B2
(45) Date of Patent: Oct. 1, 2013

(54) VARIABLE VALVE TIMING CONTROL APPARATUS

(75) Inventors: Yuji Noguchi, Obu (JP); Kazunari Adachi, Chiryu (JP); Takeo Asahi, Kariya (JP); Atsushi Homma, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 262 days.

(21) Appl. No.: 13/163,911

(22) Filed: Jun. 20, 2011

(65) Prior Publication Data

US 2012/0006290 A1 Jan. 12, 2012

(30) Foreign Application Priority Data

Jul. 8, 2010 (JP) ..... 2010-155998

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | | |
|---|---|---|---|---|
| 5,947,067 | A | 9/1999 | Kawaharaguchi et al. | |
| 6,012,419 | A | 1/2000 | Iwasaki et al. | |
| 6,412,463 | B1 | 7/2002 | Kinugawa | |
| 7,484,486 | B2 * | 2/2009 | Knecht et al. | 123/90.31 |

FOREIGN PATENT DOCUMENTS

| | | | |
|---|---|---|---|
| EP | 2 014 881 | A2 | 1/2009 |
| JP | 11-311108 | A | 11/1999 |
| JP | 2001-132415 | A | 5/2001 |
| JP | 2001-193421 | A | 7/2001 |

OTHER PUBLICATIONS

European Search Report issued by the European Patent Office on Feb. 28, 2012 in European Application No. 11170626.3. (6 pages).

* cited by examiner

*Primary Examiner* — Ching Chang
(74) *Attorney, Agent, or Firm* — Buchanan Ingersoll & Rooney PC

(57) ABSTRACT

A variable valve timing control apparatus, includes a drive-side rotary member, a driven-side rotary member, a partition portion arranged at least one of the drive-side rotary member and the driven-side rotary member to partition a fluid pressure chamber into an advanced angle chamber and a retarded angle chamber, a seal member arranged at a portion of the partition portion, which faces the other one of the drive-side rotary member and the driven-side rotary member, the seal member avoiding a hydraulic fluid from leaking between the advanced angle chamber and the retarded angle chamber, and a biasing member biasing the seal member, wherein at least one of the partition portion and a facing surface of the other one of the drive-side rotary member and the driven-side rotary member facing the partition portion is defined by an inclined surface of a tapered portion.

17 Claims, 6 Drawing Sheets

VARIABLE VALVE TIMING CONTROL APPARATUS

CROSS REFERENCE TO RELATED APPLICATIONS

This application is based on and claims priority under 35 U.S.C. §119 to Japanese Patent Application 2010-155998, filed on Jul. 8, 2010, the entire content of which is incorporated herein by reference.

TECHNICAL FIELD

This disclosure generally relates to a variable valve timing control apparatus.

BACKGROUND DISCUSSION

A variable valve timing control apparatus generally includes a drive-side rotary member rotating in synchronization with a rotation of a crank shaft, and a driven-side rotary member arranged coaxially with the drive-side rotary member and rotating in synchronization with a rotation of a cam shaft for opening and closing a valve of an internal combustion engine. A fluid pressure chamber is formed by the drive-side rotary member and the driven-side rotary member. The fluid pressure chamber is partitioned into advanced angle chambers and retarded angle chambers by partition portions arranged at the driven-side rotary member. A hydraulic fluid is supplied to and discharged from the advanced angle chambers and the retarded angle chambers to thereby control a relative rotational phase of the driven-side rotary member to the drive-side rotary member.

In such variable valve timing control apparatus, leakage of the hydraulic fluid between each advanced angle chamber and each retarded angle chamber needs to be avoided. For example, a known variable valve timing control apparatus disclosed in JP2001-132415A (hereinafter referred to as Reference 1) includes a housing serving as the drive-side rotary member and a vane member serving as the driven-side rotary member. Vane portions serving as the partition portions are arranged at the vane member. Seal members are provided at portions of the vane member facing the drive-side rotary member or the driven-side member. Furthermore, seal members are provided and portions of the drive-side rotary member or the driven-side rotary member facing the vane portions.

According to the variable valve timing control apparatus, the drive-side rotary member having a cylindrical shape is generally manufactured by an extrusion molding process. An inner circumferential wall of the extrusion-molded drive-side rotary member is generally weak against wear. Therefore, the wear resistance of the inner circumferential wall is required to increase. Accordingly, according to the variable valve timing control apparatus disclosed in Reference 1, an inner circumferential wall of the drive-side rotary member manufactured by an extrusion molding process is coated with a self-lubricating resin film or anodized aluminum film in order to increase the wear resistance of the inner circumferential wall.

On the other hand, for example, in a case where the drive-side rotary member of the variable valve timing control apparatus disclosed in Reference 1 is manufactured by a die-casting process, the wear resistance of the inner circumferential wall of the die-cast drive-side rotary member is increased compared to the wear resistance of the inner circumferential wall of the extrusion-molded drive-side rotary member. Accordingly, the inner circumferential wall of the die-cast drive-side rotary member does not need to be coated with the self-lubricating resin film or anodized aluminum film for increasing the wear resistance. However, in the case of the die-cast molding of the drive-side rotary member, a tapered portion is formed on the inner circumferential wall of the drive-side rotary member in order that the die-cast drive-side rotary member is easily removed from a die-casting mold. Further, the inner circumferential wall needs to be machined in order to remove the tapered portion from the inner circumferential wall. In the case that the die-cast drive-side rotary member is machined to remove the tapered portion from the inner circumferential wall, cavities formed inside the die-cast drive-side rotary member may be exposed to the outer side, which may result in decreasing a sealing performance of the seal member.

A need thus exists for a variable valve timing control apparatus, which is not susceptible to the drawback mentioned above.

SUMMARY

According to an aspect of this disclosure, a variable valve timing control apparatus, includes a drive-side rotary member rotating in synchronization with a rotation of a crank shaft, a driven-side rotary member arranged coaxially with the drive-side rotary member and rotating in synchronization with a rotation of a cam shaft for opening and closing a valve of an internal combustion engine, a partition portion arranged at least one of the drive-side rotary member and the driven-side rotary member to partition a fluid pressure chamber, which is formed by the drive-side rotary member and the driven-side rotary member, into an advanced angle chamber and a retarded angle chamber, a seal member arranged at a portion of the partition portion, which faces the other one of the drive-side rotary member and the driven-side rotary member, the seal member avoiding a hydraulic fluid from leaking between the advanced angle chamber and the retarded angle chamber due to a relative rotation between the drive-side rotary member and the driven-side rotary member, and a biasing member elastically deformed to exert a biasing force to bias the seal member from the partition portion arranged at the one of the drive-side rotary member and the driven-side rotary member toward the other one of the drive-side rotary member and the driven-side rotary member, wherein at least one of the drive-side rotary member and the driven-side rotary member is manufactured by a die-casting process, and wherein at least one of the partition portion and a facing surface of the other one of the die-cast drive-side rotary member and the die-cast driven-side rotary member facing the partition portion is defined by an inclined surface of a tapered portion.

According to another aspect of the disclosure, a variable valve timing control apparatus, includes a drive-side rotary member rotating in synchronization with a rotation of a crank shaft, a driven-side rotary member arranged coaxially with the drive-side rotary member and rotating in synchronization with a rotation of a cam shaft for opening and closing a valve of an internal combustion engine, a partition portion arranged at least one of the drive-side rotary member and the driven-side rotary member to partition a fluid pressure chamber, which is formed by the drive-side rotary member and the driven-side rotary member, into an advanced angle chamber and a retarded angle chamber, a seal member arranged at a portion of the partition portion, which faces the other one of the drive-side rotary member and the driven-side rotary member, the seal member avoiding a hydraulic fluid from leaking between the advanced angle chamber and the retarded angle chamber due to a relative rotation between the drive-side rotary member and the driven-side rotary member, and a biasing member elastically deformed to exert a biasing force to bias the seal member from the partition portion arranged at the one of the drive-side rotary member and the driven-side rotary member toward the other one of the drive-side rotary member and the driven-side rotary member, wherein at least one of the partition portion and a facing surface of the other one of the drive-side rotary member and the driven-side rotary member facing the partition portion is defined by an inclined surface of a tapered portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

[Embodiment ]An embodiment of a variable valve timing control apparatus of this disclosure will be explained with reference to illustrations of FIGS. 1 to 4. In the embodiment, an engine E for a vehicle corresponds to an internal combustion engine.

Figure 1:
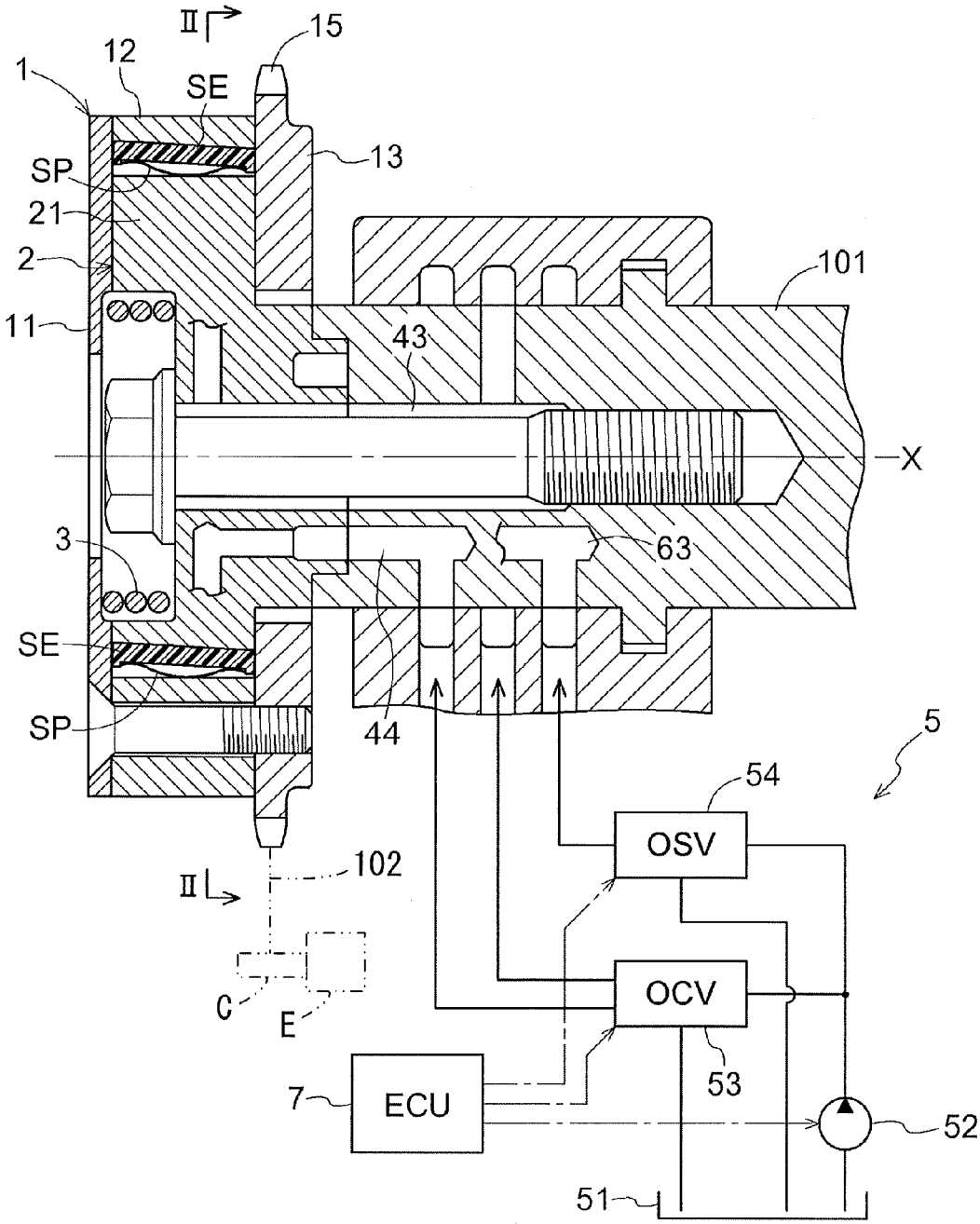
FIG. 1 is a cross sectional view illustrating an overall configuration of a variable valve timing control apparatus according to an embodiment disclosed here.

[Overall configuration] As illustrated in FIG. 1, the variable valve timing control apparatus according to the embodiment includes a housing 1 serving as a drive-side rotary member rotating in synchronization with a rotation of a crank shaft C of the engine E, and an inner rotor 2 arranged coaxially with the housing 1 and serving as a driven-side rotary member rotating in synchronization with a rotation of a cam shaft 101. The cam shaft 101 is a rotary shaft of a cam controlling opening and closing operations of an intake valve of the engine E. Further, the cam shaft 101 is rotatably attached to a cylinder head of the engine E.

[Inner rotor and housing] As illustrated in FIG. 1, the inner rotor 2 is integrally attached to an axial end of the cam shaft 101. The housing 1 includes a front plate 11, a rear plate 13, and an outer rotor 12 integrally including a timing sprocket 15. The front plate 11 is arranged at a first side of the housing 1 opposite to a second side of the housing 1 in a coaxial manner relative to a direction of a rotational axis X (serving as an axis) of the cam shaft 101. The rear plate 12 is arranged at the second side to which the cam shaft 101 is connected.

The crank shaft C is rotationally driven in accordance with an operation of the engine E, so that a driving force of the crank shaft C is transmitted to the timing sprocket 15 via a driving force transmission member 102. Accordingly, the housing 1 rotates in a rotating direction indicated by an arrow S in FIG. 2. The inner rotor 2 is rotationally driven in the rotating direction S in accordance with the rotation of the housing 1, therefore rotating the cam shaft 101 and allowing the cam arranged at the cam shaft 101 to downwardly move the intake valve of the engine E to open the intake valve.

Figure 2:
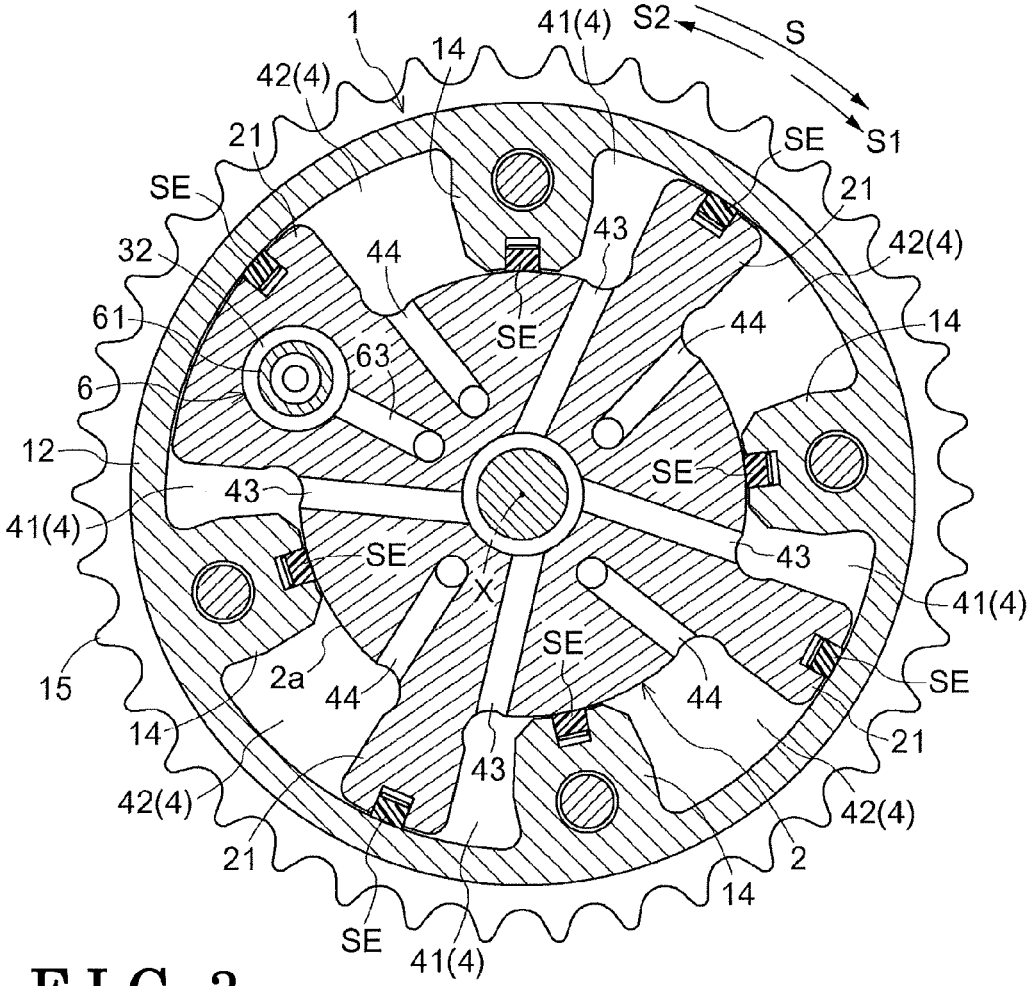
FIG. 2 is a cross sectional view taken along the line II-II of FIG. 1 and illustrating the variable valve timing control apparatus according to the embodiment disclosed here when being in a locked state.

As illustrated in FIG. 2, the outer rotor 12 includes plural protruding portions 14 inwardly protruding in the radial direction of the outer rotor 12 and positioned at intervals from one another along the rotating direction S; thereby, fluid pressure chambers 4 are formed by the outer rotor 12 and the inner rotor 2. Each of the protruding portions 14 serves as a shoe slidably contacting an outer circumferential surface (facing surface) of the inner rotor 2. The inner rotor 2 includes protruding portions 21 outwardly protruding in a radial direction of the inner rotor 2. Each of the protruding portions 21 is arranged at a portion of the outer circumferential surface, which faces each of the fluid pressure chambers 4. The fluid pressure chamber 4 is partitioned by the protruding portion 21 into an advanced angle chamber 41 and a retarded angle chamber 42 along the rotating direction S. That is, the protruding portion 21 corresponds to a partition portion in the embodiment. The protruding portion 14 partitions the fluid pressure chamber 4 into the advanced angle chamber 41 and the retarded angle chamber 42 and therefore corresponds to the partition portion in the embodiment. In addition, the four fluid pressure chambers 4 are formed in the embodiment; however, less than or more than the four fluid pressure chambers 4 may be formed at the variable valve timing control apparatus.

As illustrated in FIGS. 1 and 2, an advanced angle passage 43 connecting each advanced angle chamber 41 to a predetermined port of an oil control valve (OCV) that will be described below, is formed in the inner rotor 2 and the cam shaft 101. Further, a retarded angle passage 44 connecting each retarded angle chamber 42 to a predetermined port of the OCV 53 is formed in the inner rotor 2 and the cam shaft 101. The OCV 53 is controlled by an ECU (engine control unit) 7 to supply/discharge a hydraulic fluid to/from the advanced angle chambers 41 and the retarded angle chambers 42 through the corresponding advanced angle passages 43 and the corresponding retarded angle passages 44, or to stop the supply/discharge of the hydraulic fluid from/to the advanced angle chambers 41 and the retarded angle chambers 42. As a result, a hydraulic pressure of the hydraulic fluid is applied to the protruding portions 21. Thus, a relative rotational phase between the housing 1 and the inner rotor 2 is shifted in an advanced angle direction or a retarded angle direction, or is maintained in any desired phase. The advanced angle direction indicated by an arrow S1 in FIG. 2 is a direction in which a capacity of the advanced angle chamber 41 increases. Meanwhile, the retarded angle direction indicated by an arrow S2 in FIG. 2 is a direction in which a capacity of the retarded angle chamber 42 increases. In addition, a most retarded angle phase is obtained when the capacity of the retarded angle chamber 42 is largest. Meanwhile, a most advanced angle phase is obtained when the capacity of the advanced angle chamber 41 is largest.

The inner rotor 2 and the housing 1 are manufactured by a die-casting process or an extrusion molding process. In a case where the inner rotor 2 is manufactured by the die-casting process, a tapered portion 2*a* is formed on the outer circumferential surface of the inner rotor 2. In a case where the housing 1 is manufactured by the die-casting process, a tapered portion 12*a* is formed on an inner circumferential surface (facing surface) of the outer rotor 12.

[Lock mechanism] The variable valve timing control apparatus includes a lock mechanism 6 that may lock the relative rotational phase of the inner rotor 2 to the housing 1 at a predetermined phase between the most retarded angle phase and the most advanced angle phase (the predetermined phase will be hereinafter referred to as a lock phase). In a state where the hydraulic pressure of the hydraulic fluid is not stable right after the engine E starts, the lock mechanism 6 locks the relative rotational phase at the lock phase in order to appropriately maintain a rotational phase of the cam shaft 101 relative to a rotational phase of the crank shaft C; thereby, a stable rotating speed of the engine E may be obtained. For example, in the case that the lock phase is set as a phase where an opening timing of the intake valve overlaps an opening timing of an exhaust valve, hydrocarbon (HC) emissions at the start timing of the engine E may be reduced and the low-emission engine E may be achieved.

As illustrated in FIGS. 1 and 2, the lock mechanism 6 includes a lock member 61 and a lock passage 63 that connects a lock groove to a predetermined port of a fluid switch valve (OSV) 54 that will be described below. The lock member 61, which is arranged in an accommodating portion 32 formed in the inner rotor 2, is configured to as to protrude into and retract from the lock groove formed in the rear plate 13, so that the relative rotational phase between the housing 1 and the inner rotor 2 may be locked at and unlocked from the lock phase.

[Supply/discharge mechanism of hydraulic fluid] As illustrated in FIG. 1, a hydraulic fluid supply/discharge mechanism 5 includes an oil pan 51, an oil pump 52, the OCV 53, and the OSV 54. An engine oil serving as the hydraulic fluid, is stored in the oil pan 51. The oil pump 52 serves as a mechanical pump that is driven by the driving force of the crank shaft C. As described above, the OCV 53 serving as an electromagnetic oil control valve controls the supply and discharge of the engine oil to and from the advanced angle passages 43 and the retarded angle passages 44 and stops the supply and discharge of the engine oil. The OSV 54 serving as an electromagnetic oil switching valve controls the supply and discharge of the engine oil to and from the lock passage 63. The OCV 53 and the OSV 54 are controlled by the ECU 7.

The OCV 53 consisting of cylindrical spools is actuated in accordance with electricity, which is supplied thereto and which is controlled by the ECU 7. The OCV 53 is switched between opened and closed states, thereby controlling the supply and discharge of the engine oil to and from the advanced angle passages 43 and the retarded angle passages 44 and stopping the supply and discharge of the engine oil.

The OSV 54 consisting of cylindrical spools is actuated in accordance with electricity, which is supplied thereto and which is controlled by the ECU 7. The OSV 54 is switched between opened and closed states, thereby controlling the supply and discharge of the engine oil to and from the lock passage 63.

[Torsion spring] As illustrated in FIG. 1, a torsion spring 3 is arranged so as to extend between the front plate 11 and the inner rotor 2. The torsion spring 3 exerts a biasing force to the housing 1 and the inner rotor 2 so that the relative rotational phase between the housing 1 and the inner rotor 2 shifts in the advanced angle direction S1 seen in FIG. 2. Generally, while the engine E is in operation, a shifting force to shift the relative rotational phase in the retarded angle direction S2 or the advanced angle S1 in response to torque fluctuations of the cam shaft 101 acts on the inner rotor 2 serving as the driven-side rotary member. The shifting force tends to acts on the inner rotor 2 in the retarded angle direction S2, therefore shifting the inner rotor 2 toward the retarded angle direction S2. However, according to the embodiment, because the torsion spring 3 is arranged between the housing 1 and the inner rotor 2, the relative rotational phase may be smoothly and promptly shifted toward the advanced angle direction S1 without being influenced by the shifting force generated in response to the torque fluctuations of the cam shaft 101.

[Seal member and biasing member] The outer rotor 12 includes the protruding portions 14 inwardly protruding from a cylinder-shaped member of the outer rotor 12. The inner rotor 2 includes protruding portions 21 protrude radially outwardly from an outer circumferential surface of a cylindrical member of the inner rotor 2. Here, for example, in a case where the outer rotor 12 is manufactured by the die-casting process, the tapered portion 12*a* is formed on the inner circumferential surface of the outer rotor 12. Meanwhile, in a case where the inner rotor 2 is manufactured by the die-casting process, the tapered portion 2*a* is formed on the outer circumferential surface of the inner rotor 2. After the outer rotor 12 and the inner rotor 2 are manufactured by the die-casting process, the tapered portions 12*a* and 2*a* are generally machined so as to be removed from the inner circumferential surface of the outer rotor 12 and from the outer circumferential surface of the inner rotor 2, respectively. However, the tapered portions 12*a* and 2*a* are not machined in the embodiment. In such a case where the tapered portions 12*a* and 2*a* are not machined, clearances are generated between each protruding portion 14 and the inner rotor 2, between each protruding portion 21 and the outer rotor 12, and the like. Accordingly, the hydraulic fluid may leak between the advanced angle chamber 41 and the retarded angle chamber 42 through the clearances. As a result, the relative rotational phase between the housing 1 and the inner rotor 2 may not be accurately controlled and appropriate opening and closing operations of the intake valve depending on operating conditions of the engine E may not be achieved.

According to the variable valve timing control apparatus of the embodiment, as illustrated in FIGS. 1 and 2, a seal member SE is provided at a portion of each of the protruding portions 14, which face the inner rotor 2, and similarly, the seal member SE is provided at a portion of each of the protruding portions 21, which face the outer rotor 12, in order to prevent the leakage of the hydraulic fluid. Further, biasing members SP biasing the seal members SE toward the inner rotor 2 and the outer rotor 12 are arranged at the facing portions of the protruding portions 14 and the protruding portions 21, respectively, in order to increase the seal performance of the seal members SE. Detailed explanations of each of the seal members SE and each of the biasing members SP will be described below. In addition, the seal member SE and the biasing member SP that are arranged at the facing portion of each of the protruding portions 14 relative to the inner rotor 2 have substantially the same configurations as those of the seal member SE and the biasing member SP that are arranged at the facing portion of each of the protruding portions 21 relative to the outer rotor 12. Therefore, one of the seal members SE and one of the biasing members SP that are arranged at the facing portion of one of the protruding portions 21 relative to the outer rotor 12 will be hereinafter explained.

Figure 3:
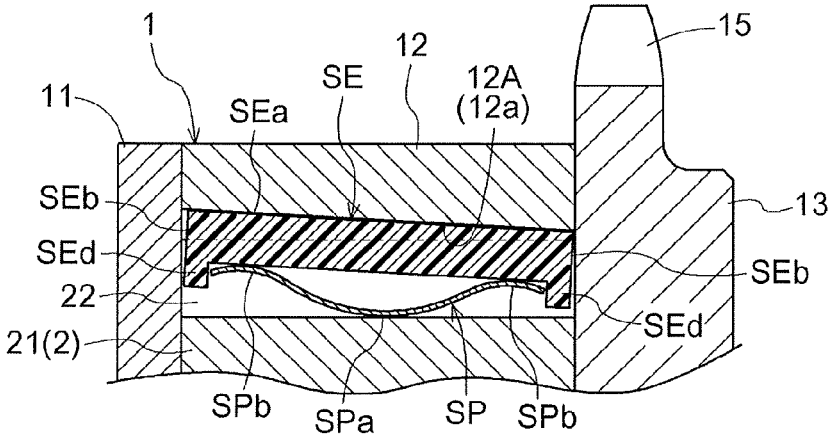
FIG. 3 is an enlarged view of a portion of the variable valve timing control apparatus in the vicinity of a protruding portion of an inner rotor of the variable valve timing control apparatus according to the embodiment disclosed here.

As illustrated in FIGS. 2 and 3, an attachment groove 22 extending from the front plate 11 to the rear plate 13 along the direction of the rotational axis X is formed at a radially outward end of the facing portion of the protruding portion 21 relative to the outer rotor 12. The attachment groove 22 has a substantially rectangular shape in cross-section. An attachment groove identical to the attachment groove 22 is formed at a radially inward end of the facing portion of each of the protruding portions 14 relative to the outer rotor 12.

Figure 4:
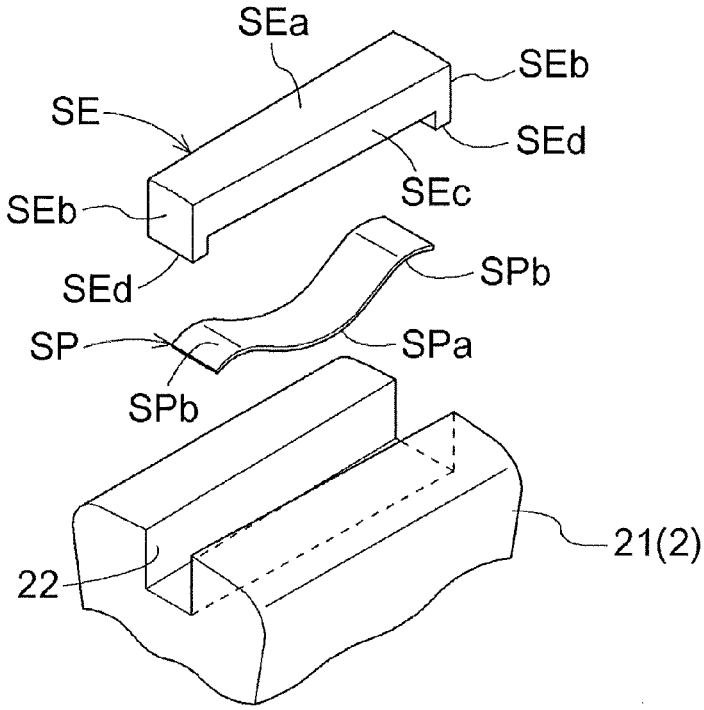
FIG. 4 is a cross sectional view of a seal member and a biasing member of the variable valve timing control apparatus according to the embodiment disclosed here.

The seal member SE is formed to be slidable in the radial direction of the inner rotor 2 and along the shape of the attachment groove 22. As illustrated in FIG. 4, the seal member SE includes a slidable contact portion SEa, circumferential wall portions SEb extending along the rotating direction of the inner rotor 2, side wall portions SEc extending along a thickness direction of the inner rotor 2, and leg portions SEd. The slidable contact portion SEa slidably contacts the inner circumferential surface of the outer rotor 12. The slidable contact portion SEa is formed in a circular arc in cross-section. The circumferential wall portions SEb and the side wall portions SEc are vertically formed at four peripheral edges of the circular arc in cross-section of the slidable contact portion SEa so as to have a box shape. The leg portions SEd are formed so as to vertically extend from the respective circumferential wall portions SEb contacting the front plate 11 and the rear plate 13, respectively. As illustrated in FIG. 4, a long-side dimension of the slidable contact portion SEa, which is defined in the thickness direction of the inner rotor 2, will be hereinafter referred to as a "length" and a short-side dimension of the slidable contact portion SEa, which is defined in the rotating direction of the inner rotor 2, will be hereinafter referred to as a "width". Further, a dimension of each leg portion SEd extending vertically from each circumferential wall portion SEb will be hereinafter referred to as a "height".

As illustrated in FIGS. 3 and 4, the biasing member SP includes an intermediate portion SPa curved toward the attachment groove 22, and end portions SPb curved toward the seal member SE. In particular, the biasing member SP serves as a plate spring curved into a substantially circular arc. Thus, the biasing member SP is elastically deformed to thereby exert a biasing force.

As illustrated in FIG. 3, the seal member SE is biased by the biasing member SP relative to the circumferential inner surface of the outer rotor 12; therefore, the slidable contact portion SEa is brought into contact with an inclined surface 12A of the tapered portion 12*a* of the outer rotor 12 while forming minor clearances between the front plate 11 and the circumferential wall portion SEb adjacent to the front plate 11 and between the rear plate 13 and the circumferential wall portion SEb adjacent to the rear plate 13.

According to the embodiment, portions of the seal member SE, which are adjacent to the front plate 11 and the rear plate 13, respectively, are pressed by the biasing member SP toward the inclined surface 12A of the tapered portion 12*a*; thereby, the seal member SE is biased by the biasing member SP toward the outer rotor 12. Accordingly, the biasing member SP offsets the inclination of the tapered portion 12*a*. In other words, the biasing member SP biases the seal member SE toward the outer rotor 12 while not being affected by the inclination of the tapered portion 12*a*.

The seal member SE and the biasing member SP may be configured in a different manner from the configurations described in the embodiment. Modified examples of the embodiment will be explained as follows with reference to illustrations of FIGS. 5 to 14. Explanations of configurations similar to those in the embodiment will be omitted. In addition, the same reference numerals will be applied to the same components or portions as those in the embodiment.

Figure 5:
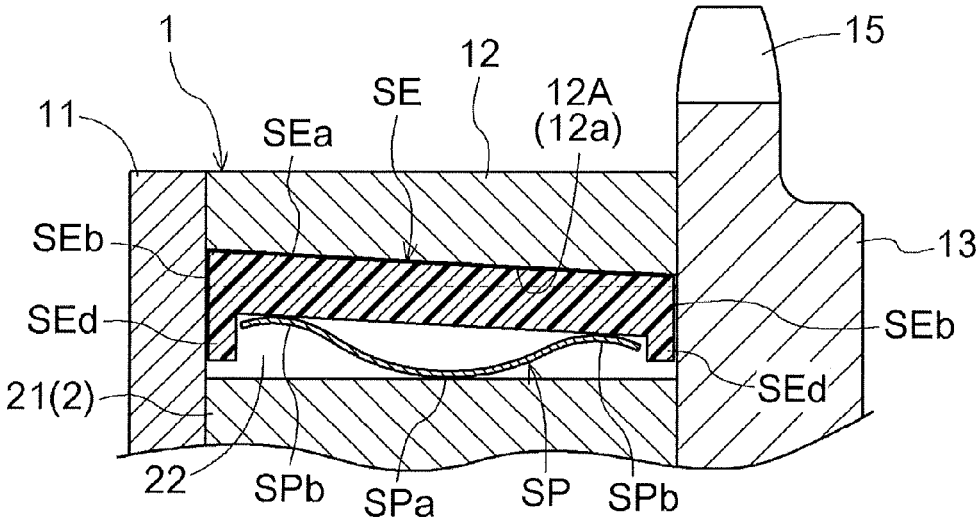
FIG. 5 is an enlarged view of a portion of the variable valve timing control apparatus in the vicinity of the protruding portion of the inner rotor according to a first modified example of the embodiment disclosed here.

For example, as illustrated in FIG. 5, according to the variable valve timing control apparatus of a first modified example of the embodiment, the seal member SE may be configured in such a way that the circumferential wall portions SEb are in tight contact with the front plate 11 and the rear plate 13, respectively, so as not to form the clearances between the seal member SE and the front plate 11 and between the seal member SE and the rear plate 13 in a state where the slidable contact portion SEa is in contact with the inclined surface 12A of the tapered portion 12*a*. As a result, a liquid-sealed condition between the advanced angle chamber 41 and the retarded angle chamber 42 increases.

Figure 6:
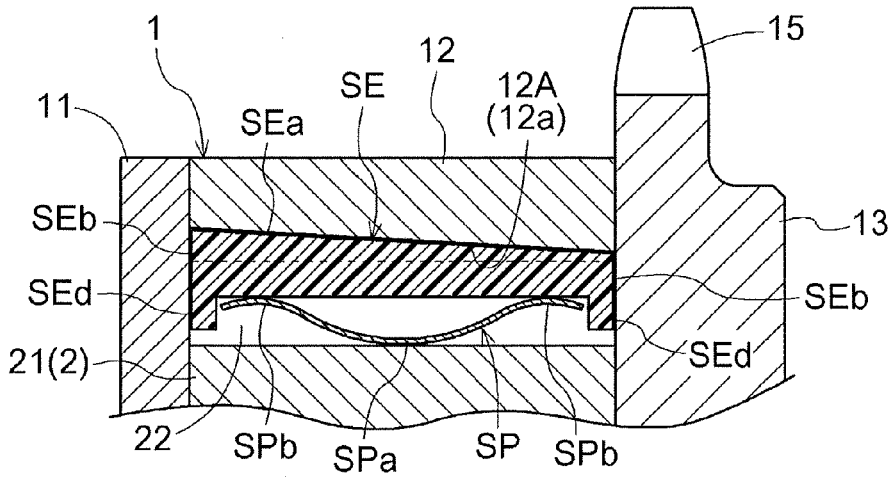
FIG. 6 is an enlarged view of a portion of the variable valve timing control apparatus in the vicinity of the protruding portion of the inner rotor according to a second modified example of the embodiment disclosed here.

For example, as illustrated in FIG. 6, according to the variable valve timing control apparatus of a second modified example of the embodiment, the seal member SE is formed as follows. A facing surface of the seal member SE, which faces the inclined surface 12A of the tapered portion 12*a*, is formed to be in parallel with the inclined surface 12A. A facing surface of the seal member SE, which faces a radially inwardly recessed portion of the outer circumferential surface of the inner rotor 2, is formed to be in parallel with the radially inwardly recessed portion that is not inclined. The seal member SE configured as described above is biased by the biasing member SP so as to be in tight contact with inclined surface of 12A of the tapered portion 12*a* while not being affected by the inclination of the tapered portion 12*a*. Accordingly, the liquid-sealed condition between the advanced angle chamber 41 and the retarded angle chamber 42 may be secured. In such case, the biasing member SP approximately uniformly presses the portions of the seal member SE, which are adjacent to the front plate 11 and the rear plate 13, in a thickness direction of the outer rotor 12. In other words, the seal member SP is uniformly biased by the biasing member SP in a direction in which the tapered portion 12*a* gradually tapers and in an opposite direction of the direction in which the tapered portion 12*a* gradually tapers.

Figure 7:
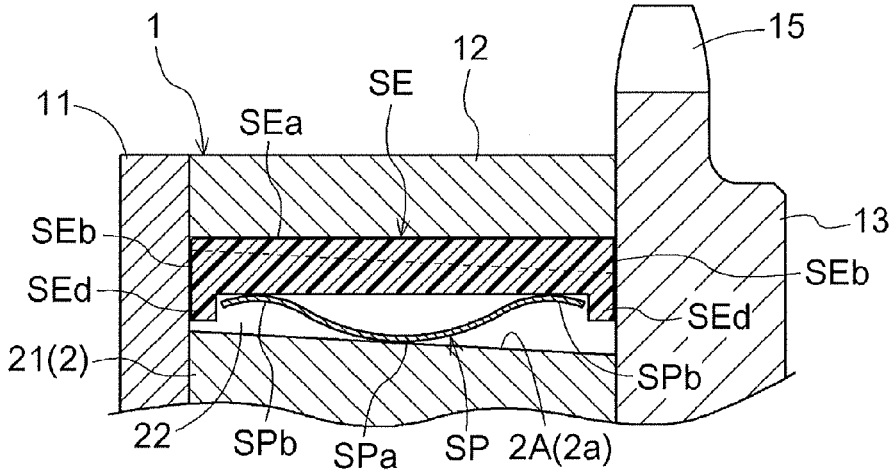
FIG. 7 is an enlarged view of a portion of the variable valve timing control apparatus in the vicinity of the protruding portion of the inner rotor according to a third modified example of the embodiment disclosed here.

For example, as illustrated in FIG. 7, according to the variable valve timing control apparatus of a third modified example of the embodiment, the inner rotor 2 is manufactured by the die-casting process and the tapered portion 2*a* is formed on the outer circumferential surface of the inner rotor 2. The tapered portion 2*a* is designed to gradually taper toward the rear plate 13. In the third modified example of the embodiment, a know seal member is adapted as the seal member SE, however, because of the biasing means SP, the seal member SE is tightly in contact with the inner circumferential surface of the outer rotor 12 without forming clearances between the front plate 11 and the circumferential wall portion SEb adjacent to the front plate 11 and between the rear plate 13 and the circumferential wall portion SEb adjacent to the rear plate 13. The biasing member SP is configured to press the portions of the seal member SE, which are adjacent to the front plate 11 and the rear plate 13, respectively. In particular, a distance defined between the outer circumferential surface of the inner rotor 2 and the seal member SE in the vicinity of the rear plate 13 has a longer distance compared to a distance defined between the outer circumferential surface of the inner rotor 2 and the seal member SE in the vicinity of the front plate 11. Even the portion of the seal member SE, which is adjacent to the rear plate 13 is surely biased by the biasing member SP toward the outer rotor 12. Thus, the biasing member SP biases the seal member SE toward the outer rotor 12 while not being affected by the inclination of the tapered portion 2*a* of the inner rotor 2.

Figure 8:
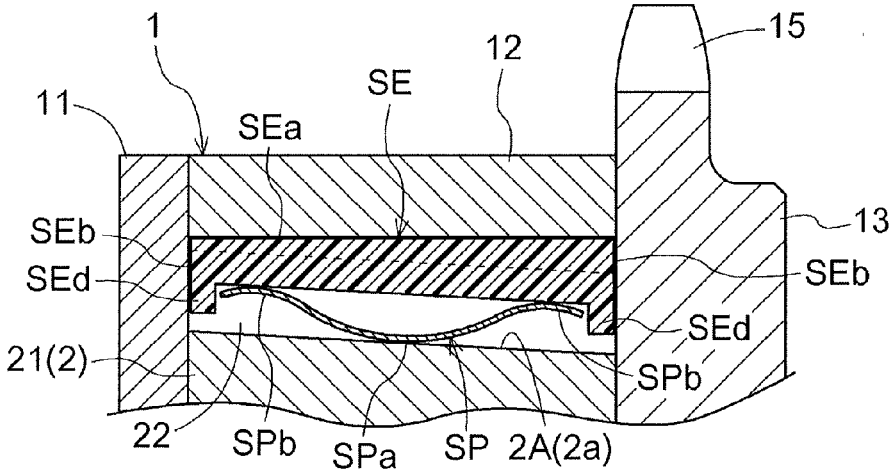
FIG. 8 is an enlarged view of a portion of the variable valve timing control apparatus in the vicinity of the protruding portion of the inner rotor according to a fourth modified example of the embodiment disclosed here.

For example, as illustrated in FIG. 8, according to the variable valve timing control apparatus of a fourth modified example of the embodiment, the seal member SE is formed as follows. The facing surface of the seal member SE relative to the tapered portion 2*a* is formed to be in parallel with the inclined surface 2A of the tapered portion 2*a*. Accordingly, a clearance defined between the seal member SE and the inclined surface 2A of the tapered portion 2*a* in the radial direction where the biasing member SP biases the seal member SE is substantially uniform along the thickness direction of the inner rotor 2 (along the direction of the rotational axis X). Consequently, the seal member SE is biased by the biasing member SP toward the outer rotor 12 while not being affected the inclination of the tapered portion 2*a*. As a result, the biasing member SP biases the portions of the seal member SE, which are adjacent to the front plate 11 and the rear plate 13, respectively, by the substantially uniform biasing force.

Figure 9:
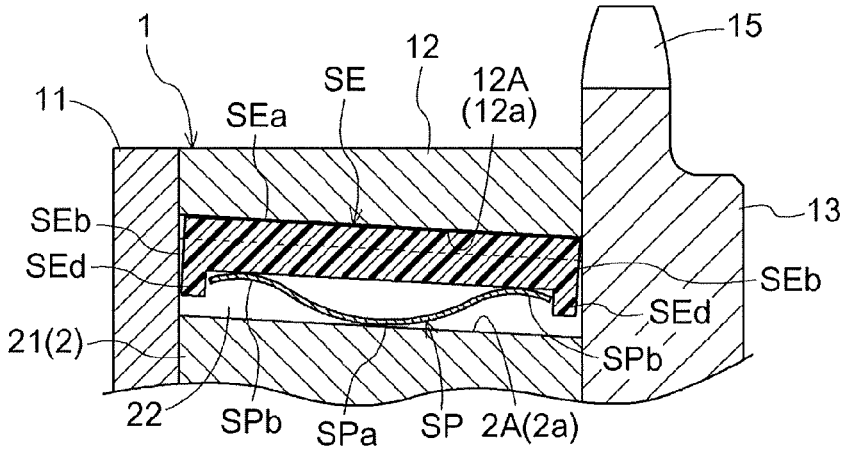
FIG. 9 is an enlarged view of a portion of the variable valve timing control apparatus in the vicinity of the protruding portion of the inner rotor according to a fifth modified example of the embodiment disclosed here.

For example, as illustrated in FIG. 9, according to the variable valve timing control apparatus of a fifth modified example of the embodiment, the tapered portions 2*a* and 12*a* are formed on the outer circumferential surface of the inner rotor 2 and on the inner circumferential surface of the outer rotor 12, respectively. Further, the inclined surface 2A of the tapered portion 2*a* and the inclined surface 12A of the tapered portion 12*a* are designed to be in parallel with each other. In such case of the aforementioned configurations of the tapered portions 2*a* and 12*a*, clearances in the radial direction within the attachment groove 22 defined between the outer rotor 12 and the inner rotor 2 are substantially equal to each other in the thickness direction of the inner rotor 2. As a result, the known seal member may be adapted as the seal member SE and a known biasing member SP may be adapted as the biasing member SP while not being affected by the inclinations of the tapered portion 2*a* and the tapered portion 12*a*.

Figure 10:
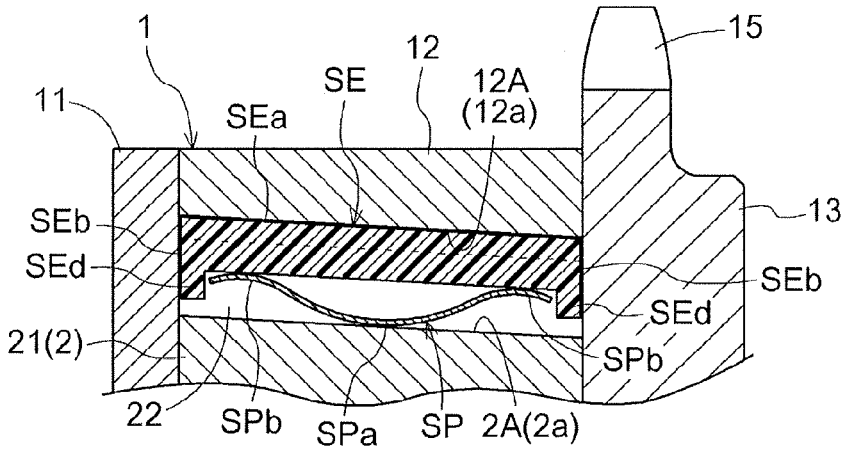
FIG. 10 is an enlarged view of a portion of the variable valve timing control apparatus in the vicinity of the protruding portion of the inner rotor according to a sixth modified example of the embodiment disclosed here.

For example, as illustrated in FIG. 10, according to the variable valve timing control apparatus of a sixth modified example of the embodiment, the tapered portions 2*a* and 12*a* are formed on the outer circumferential surface of the inner rotor 2 and on the inner circumferential surface of the outer rotor 12, respectively, in the same way as in the fifth modified example. Further, the inclined surface 2A of the tapered portion 2*a* and the inclined surface 12A of the tapered portion 12*a* are designed to be in parallel with each other. In such case of the aforementioned configurations of the tapered portions 2*a* and 12*a*, the seal member SE is configured as follows. The circumferential wall portions SEb are in tight contact with the front plate 11 and the rear plate 13 so as not to form clearances relative to the front plate 11 and the rear plate 13, respectively, in a state where the slidable contact portion SEa is in tight contact with the inclined surface 12A of the tapered portion 12*a*. As a result, the liquid-sealed condition between the advanced angle chamber 41 and the retarded angle chamber 42 increases.

For example, in a case where the seal member SE is in contact with the tapered portion 12*a* formed on the inner circumferential surface of the outer rotor 12 and the seal member SE is biased by the biasing force SP, the seal member SE extending in the thickness direction of the outer rotor 12 tends to shift toward the front plate 11 due to the inclination of the tapered portion 12*a*, i.e. the seal member SE tends to shift in the opposite direction of the direction in which the tapered portion 12*a* gradually tapers.

Figure 11:
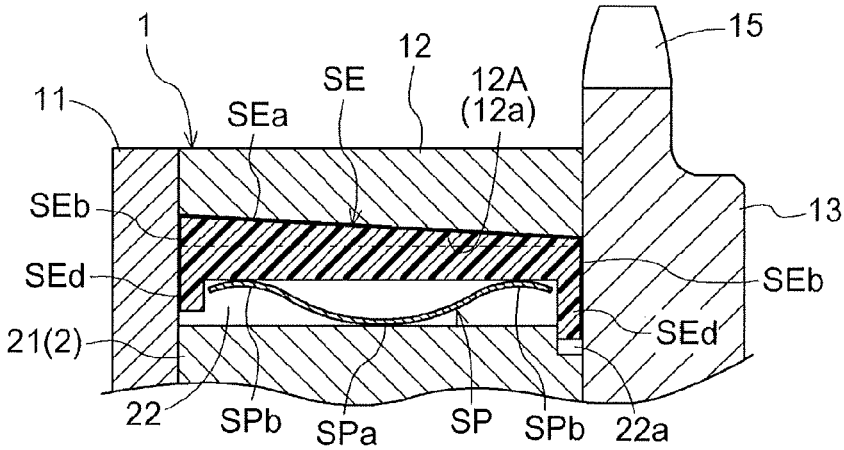
FIG. 11 is an enlarged view of a portion of the variable valve timing control apparatus in the vicinity of the protruding portion of the inner rotor according to a seventh modified example of the embodiment disclosed here.

As illustrated in FIG. 11, according to the variable valve timing control apparatus of a seventh modified example of the embodiment, a recessed engagement portion 22*a* with which the leg portion SEd adjacent to the rear plate 13 engages is formed in the attachment groove 22 of the inner rotor 2 at a position in which the tapered portion 12*a* gradually tapers toward the rear plate 13. For example, the seal member SE is biased by the biasing member SP toward the tapered portion 12*a* in a state where the leg portion SE adjacent to the rear plate 13 is engaged with the recessed engagement portion 22*a*. Consequently, the seal member SE is prevented from shifting toward the front plate 11 (in the opposite direction of the direction in which the tapered portion 12*a* gradually tapers). As a result, the slidable contact portion SEa of the seal member SE is stably brought in tight contact with the inclined surface 12A of the tapered portion 12*a*.

Figure 12:
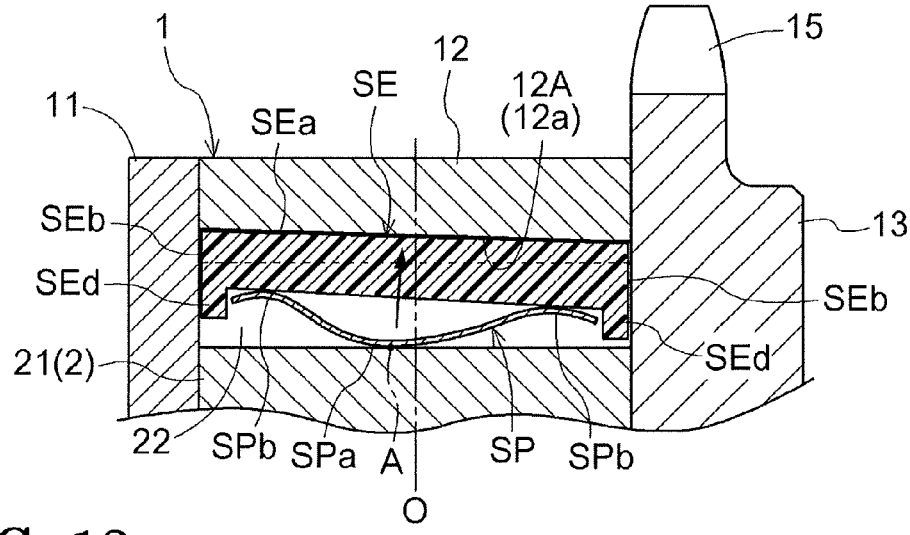
FIG. 12 is an enlarged view of a portion of the variable valve timing control apparatus in the vicinity of the protruding portion of the inner rotor according to an eighth modified example of the embodiment disclosed here.

For example, as illustrated in FIG. 12, according to the variable valve timing control apparatus of an eighth modified example of the embodiment, the seal member SE is configured as follows. The slidable contact portion SEa facing the tapered portion 12*a* is formed to be in parallel with the inclined surface 12A. Further, the facing surface of the seal member SE, which receives the biasing force of the biasing member SP, is inclined at a larger angle relative to a horizontal line compared to an angle formed by the horizontal line and the inclined surface 12A the tapered portion 12*a* gradually tapering toward the rear plate 13. As a result, the seal member SE is biased by the biasing member SP from a vertical direction (in FIG. 12) to the direction in which the tapered portion 12*a* gradually tapers (toward the right side seen in FIG. 12). That is, the biasing member SP biases the seal member SE toward the outer rotor 12 and toward the direction in which the tapered portion 12*a* gradually tapering (toward the rear plate 13). In addition, for example, when a centrifugal force acts due to the rotation of the outer rotor 12 to therefore generate a force to displace the seal member SE along the inclined surface 12A toward the opposite direction of the direction in which the tapered portion 12*a* gradually tapers. The force generated due to the centrifugal force is compensated by the biasing force of the biasing member SP, which acts toward the direction in which the tapered portion 12*a* gradually tapers. As a result, even when the centrifugal force acts due to the rotation of the outer rotor 12, the seal member SE is uniformly biased by the biasing member SP toward the radial direction of the inner rotor 2; therefore, the liquid-sealed condition between the advanced angle chamber 41 and the retarded angle chamber 42 is secured. In addition, a double dashed line 0 in FIG. 12 indicates a center line of the seal member SE in the direction of the rotational axis X and a point A in FIG. 12 indicates a contact point between the biasing member SP and the protruding portion 21 of the inner rotor 2.

Figure 13:
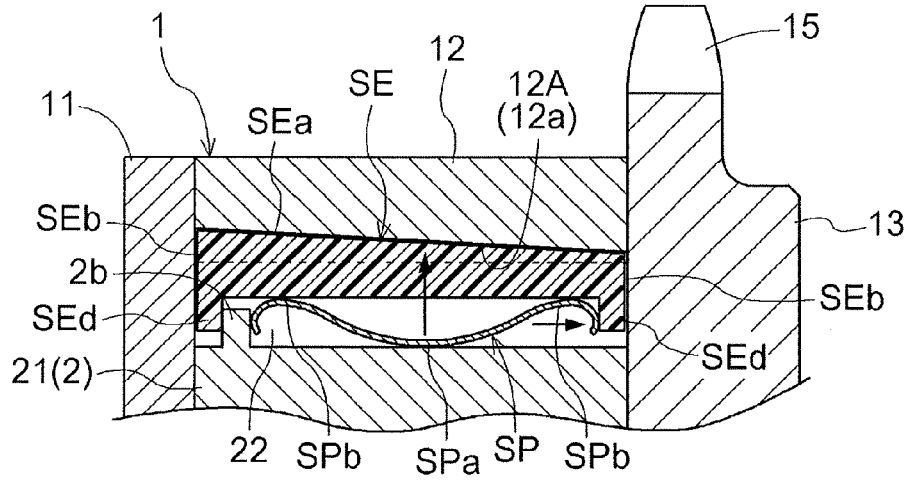
FIG. 13 is an enlarged view of a portion of the variable valve timing control apparatus in the vicinity of the protruding portion of the inner rotor according to a ninth modified example of the embodiment disclosed here.

For example, as illustrated in FIG. 13, according to the variable valve timing control apparatus of a ninth modified example of the embodiment, a contact portion 2*b* contacting the biasing member SP in the direction of the rotational axis X is formed on the outer circumferential surface of the inner rotor 2 so as to protrude therefrom in a radially outward direction of the inner rotor 2. The biasing member SP is configured to bias the seal member SE toward the outer rotor 12 and to bias the leg portion SEd adjacent to the rear plate 13 toward a direction from the contact portion 2*b* to the rear plate 13 (to the direction in which the tapered portion 12*a* gradually tapers). Thus, the seal member SE is prevented from being displaced toward the front plate 11 (toward the opposite direction of the direction in which the tapered portion 12*a* gradually tapers). As a result, the slidable contact portion SEa of the seal member SE is stably brought in tight contact with the inclined surface 12A of the tapered portion 12*a*.

Figure 14:
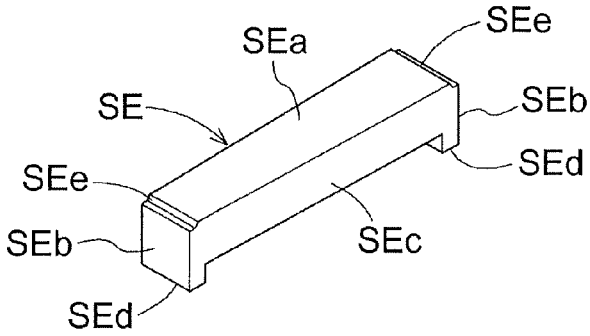
FIG. 14 is an enlarged view of a portion of the variable valve timing control apparatus in the vicinity of the protruding portion of the inner rotor according to a tenth modified example of the embodiment disclosed here.

For example, as illustrated in FIG. 14, according to the variable valve timing control apparatus of a tenth modified example of the embodiment, chamfered portions SEe are formed on corner portions of the circumferential wall portions SEb facing the front plate 11 and the rear plate 13, respectively. The corner portions of the circumferential wall portions SEb are located radially outwardly of the inner rotor 2. The engine oil is utilized in the variable valve timing control apparatus in order to rotate the inner rotor 2 relative to the housing 1. The engine oil serves as a lubricating oil supplied to a slidable portion arranged in the engine E and minute foreign substances such as sludge, iron powder, and the like are generally generated from the slidable portion and contained into the engine oil. In a case where the foreign substances penetrate between the seal member SE and the housing 1 (or between the seal member SE and the inner rotor 2), the foreign substances act as abrasive powder at the time of the relative rotation of the inner rotor 2 to the housing 1 and may therefore wear the housing 1 (or the inner rotor 2).

However, according to the variable valve timing control apparatus of the tenth modified example, because the chamfered portions SEe are formed on the corner portions of the respective circumferential wall portions SEb, the chamfered portions SEe serves as passages connecting the advanced angle chamber 41 and the retarded angle chamber 42, so that the minute amount of the engine oil is allowed to leak between the advanced angle chamber 41 and the retarded angle chamber 42 through the chamfered portions SEe to therefore discharge the foreign substances, which are penetrated between the seal member SE and the housing 1 (or between the seal member SE and the inner rotor 2), from the advanced angle chamber 41 or the retarded angle chamber 42. Accordingly, because the chamfered portions SEe are formed at the seal member SE, the wear of the housing 1 (or the inner rotor 2) may be minimized. In addition, a groove allowing the minute leakage of the engine oil between the advanced angle chamber 41 and the retarded angle chamber 42 may be formed in the slidable contact portion SEa instead of the passages.

As illustrated in FIG. 14, the chamfered portions SEe formed in L-shapes are formed on the corner portions of the circumferential wall portions SEb, respectively. However, a shape of each of the chamfered portions SEe is not limited to the L-shape. Alternatively, the chamfered portion SEe may be cut obliquely or may be formed into any shape as long as the chamfered portion SEe is formed as the passage connecting the advanced angle chamber 41 to the retarded angle chamber 42.

According to the aforementioned embodiment, the protruding portion 21 serving as the partition portion is formed at the inner rotor 2. Alternatively, for example, a groove may be formed in the inner rotor 2 and a plate vane serving as the partition portion may be arranged in the groove. In such case, the plate vane is biased toward the outer rotor 12 and therefore serves as the seal member SE. As a result, the seal member SE and the biasing member SP according to the aforementioned embodiment are arranged only at the protruding portion 14 serving as the partition portion provided at the outer rotor 12.

According to the aforementioned embodiment, the attachment groove is formed at the protruding portion 14 of the outer rotor 12 and the attachment groove 22 is formed at the protruding portion 21 of the inner rotor 2. Further, the seal members SE are arranged in the attachment groove of the outer rotor 12 and in the attachment grove 22 of the inner rotor 2. Alternatively, the attachment groove 22 may be formed at the inner rotor 2 facing the protruding portion 14 of the outer rotor 12. Further, the attachment groove may be formed at the outer rotor 12 facing the protruding portion 21 of the inner rotor 2. In this case, the seal members SE are arranged in the attachment groove 22 of the inner rotor 2 and in the attachment groove of the outer rotor 12.

The variable valve timing control apparatus according to the aforementioned embodiment is characterized by the configurations of the seal member SE and the biasing member SP; therefore, other configurations in the variable timing control apparatus may not be limited by the configurations of the seal member SE and the biasing member SP. For example, the seal member SE and the biasing member SP according to the embodiment may be adapted to a variable valve timing control apparatus arranged at the exhaust valve. In addition, the variable valve timing control apparatus according to the embodiment may not include the lock mechanism or may include a lock mechanism configured in a different manner form the lock mechanism described in the embodiment.

Moreover, according to the aforementioned embodiment, the biasing member SP is formed by the plate spring. Alternatively, the biasing member SP may be formed by a different member such as a wire spring, a mixed member of the plate spring and the wire spring, and a coil spring.

The variable valve timing control apparatus according to the embodiment of the disclosure may be utilized in the internal combustion engine of the vehicle and the like.

According to the aforementioned embodiment, the variable valve timing control apparatus, includes the housing 1 rotating in synchronization with the rotation of the crank shaft C, the inner rotor 2 arranged coaxially with the housing 1 and rotating in synchronization with the rotation of the cam shaft 101 for opening and closing the intake valve of the internal combustion engine E, the protruding portion 14, 21 arranged at least one of the housing 1 and the inner rotor 2 to partition the fluid pressure chamber 4, which is formed by the housing 1 and the inner rotor 2, into the advanced angle chamber 41 and the retarded angle chamber 42, the seal member SE arranged at the portion of the protruding portion 14, 21, which faces the other one of the housing 1 and the inner rotor 2, the seal member SE avoiding the hydraulic fluid from leaking between the advanced angle chamber 41 and the retarded angle chamber 42 due to the relative rotation between the housing 1 and the inner rotor 2, and the biasing member SP elastically deformed to exert the biasing force to bias the seal member SE from the protruding portion 14, 21 arranged at the one of the housing 1 and the inner rotor 2 toward the other one of the housing 1 and the inner rotor 2, wherein at least one of the housing 1 and the inner rotor 2 is manufactured by the die-casting process, and wherein at least one of the protruding portion 14, 21 and the facing surface of the other one of the die-cast housing 1 and the die-cast inner rotor 2 facing the protruding portion 14, 21 is defined by the inclined surface 12A, 2A of the tapered portion 12*a*, 2*a*.

As described above, the inclined surface 12A, 2A of the tapered portion 12*a*, 2*a* is arranged at least one of the protruding portion 14, 21 and the facing surface of the die-cast inner rotor 2 or the die-cast housing 1 relative to the protruding portion 14, 21. The biasing member SP biasing the seal member SE toward the protruding portion 14, 21 or toward the inner rotor 2 or the housing 1 facing the protruding portion 14, 21 is between the protruding portion 14, 21 and the facing surface of the die-cast inner rotor 2 or the die-cast housing 1 facing the protruding portion 14, 21. That is, the biasing member SP biases the seal member SE while not being affected by the inclination of the tapered portion 12*a*, 2A. Thus, the liquid-sealed condition in a clearance defined between the protruding portion 14, 21 and the inner rotor 2 or the housing 1 facing the protruding portion 14, 21 is secured by the seal member SE. As described above, the housing 1 and the inner rotor 2 are manufactured by the die-casting process, thereby increasing the wear resistance of the housing 1 and the inner rotor 2. Further, the machining process to remove the tapered portion 12*a*, 2*a* from the housing 1 or the inner rotor 2 is not required. Furthermore, since the tapered portion 12*a*, 2*a* is not machined in the embodiment, cavities formed inside the housing 1 or the inner rotor 2 manufactured by the die-casting process may not be exposed to the outer side.

According to the aforementioned embodiment, the seal member SE includes the facing surfaces facing the housing 1 and the inner rotor 2, and at least one of the facing surfaces of the seal member SE is formed to be in parallel with the inclined surface 12A, 2A of the tapered portion 12*a*, 2*a*.

In a case where the tapered portion 12*a*, 2*a* is arranged at the housing 1 or the inner rotor 2 facing the seal member SE, the facing surface of the seal member SE relative to the housing 1 or the inner rotor 2 is arranged in parallel with the inclined surface 12A, 2A of the tapered portion 12*a*, 2*a*. Meanwhile, in a case where the tapered portion 12*a*, 2*a* is arranged at the facing surface of the housing 1 or the inner rotor 2 relative to the biasing member SP, the facing surface of the seal member SE receiving the biasing member SP is arranged in parallel with the inclined surface 12A, 2A of the tapered portion 12*a*, 2*a*. Thus, at least one of the facing surfaces of the seal member SE relative to the housing 1 and the inner rotor 2 is arranged in parallel with the inclined surface 12A, 2A; thereby, the seal performance of the seal member SE may be secured.

According to the aforementioned embodiment, the contact portion 2*b* extending in the direction of the rotational axis X of the cam shaft 101 and contacting the seal member SE is arranged on at least one of the housing 1 and the inner rotor 2 so as to allow the seal member SE to exert the biasing force in the direction in which the tapered portion 12*a*, 2*a* gradually tapers.

In a case where the seal member SE is in contact with the tapered portion 12*a*, 2*a* arranged at least one of the housing 1 and the inner rotor 2 and where the biasing member SP biases the seal member SE, the inclination of the tapered portion 12*a*, 2*a* displaces the seal member SE toward the opposite direction from the direction in which the tapered portion 12*a*, 2*a* gradually tapers. However, according to the embodiment, the contact portion 2*b* extending in the direction of the rotational axis X of the cam shaft 101 is arranged on at least one of the housing 1 and the inner rotor 2 so as to contact the seal member SE in such a way that the seal member SE exerts the biasing force in the direction in which the tapered portion 12*a*, 2*a* gradually tapers. As a result, the seal member SE is biased by the biasing member SP toward the direction in which the tapered portion 12*a*, 2*a* gradually tapers, thereby restricting the seal member SE from being displaced toward the opposite direction of the direction in which the tapered portion 12*a*, 2*a* gradually tapers. Thus, the seal member SE is surely brought in contact with the inclined surface 12A, 2A of the tapered portion 12*a*, 2*a*; thereby the liquid-sealed condition between the advanced angle chamber 41 and the retarded angle chamber 42 may be secured.

According to the aforementioned embodiment, one of the inclined surfaces 12A and 2A of the tapered portions 12*a* and 2*a* arranged at the housing 1 and the inner rotor 2, respectively, and the other of the inclined surfaces 12A and 2A of the tapered portions 12*a* and 2*a* arranged at the housing 1 and the inner rotor 2, respectively, face each other and are in parallel with each other. Further, the facing surface of the other one of the housing 1 and the inner rotor 2 relative to the protruding portion 14, 21 and the facing portion of the protruding portion 14, 21 relative to the one of the housing 1 and the inner rotor 2 are defined by the inclined surfaces 12A and 2A of the tapered portions 12*a* and 2*a*.

According to the configuration of each of the tapered portions 12*a*, and 2*a*, the clearance defined between the protruding portion 14, 21 and the inner rotor 2 or the housing 1 keeps a uniform distance along the direction of the rotational axis X. Accordingly, one of the inclination of the tapered portions 12*a* and 2*a* arranged at the housing 1 and the inner rotor 2, respectively, is offset by the inclination of the other of the tapered portions 12*a* and 2*a* arranged at the housing 1 and the inner rotor 2, respectively. In other words, the seal member SE and the biasing member SP may be arranged between the protruding portion 14, 21 and the inner rotor 2 or the housing 1 while not being affected by the inclination of each tapered portion 12*a*, 2*a*. Consequently, the liquid-sealed condition between the advanced angle chamber 41 and the retarded angle chamber 42 may be secured.

According to the aforementioned embodiment, the chamfered portion SEe or the groove is formed at the outer circumferential surface of the seal member SE arranged at the facing portion of the protruding portion 21 relative to the housing 1, and the outer circumferential surface of the seal member SE is located radially outwardly of the inner rotor 2.

As described above, generally, in a case where the housing 1 and the inner rotor 2 are manufactured by the die-casting process, the wear resistance of the housing 1 and the inner rotor 2 increases. However, the strength of the housing 1 and the inner rotor 2 deteriorates compared to a case where the housing 1 and the inner rotor 2 are formed by cast-iron materials. In addition, the engine oil is utilized in the variable valve timing control apparatus and minute foreign substances are generated from the slidable contact portion SEa of the seal member SE. The foreign substances penetrate between the seal member SE and the housing 1 or between the seal member SE and the inner rotor 2 and act as abrasive powder at the time of the relative rotation of the inner rotor 2 to the housing 1. As a result, the housing 1 or the inner rotor 2 may be worn by the foreign substances.

As described above, the chamfered portion SEe or the groove is formed at the outer circumferential surface of the seal member SE so as to be located radially outwardly of the inner rotor 2; thereby the minute leakage of the engine oil between the advanced angle chamber 41 and the retarded angle chamber 42 is allowed. As a result, the foreign substances penetrated between the seal member SE and the housing 1 or between the seal member SE and the inner rotor 2 are discharged from the advanced angle chamber 41 or the retarded angle chamber 42. Thus, the housing 1 or the inner rotor 2 is prevented from being worn by the foreign substances.

According to the aforementioned embodiment, the chamfered portion SEe or the groove is formed on the corner portion of the outer circumferential surface of the seal member SE, and the corner portion of the outer circumferential surface of the seal member SE is located radially outwardly of the inner rotor 2 so as to extend along the rotating direction S of the housing 1.

Accordingly, the chamfered portion SEe or the groove is formed on the corner portion of the seal member SE, which is arranged along the rotating direction S of the housing 1; thereby, the minute leakage of the engine oil between the advanced angle chamber 41 and the retarded angle chamber 42 is allowed. In addition, the slidable contact portion SEa may be formed on the outer circumferential surface of the seal member SE so as to be located radially outward of the inner rotor 2 and in an intermediate position in the thickness direction of the housing 1 (in the direction of the rotational axis X). Moreover, the chamfered portion SEe or the groove may be easily formed on the outer circumferential surface of the seal member SE so as to be located radially outwardly of the inner rotor 2.

According to the aforementioned embodiment, the inclined surface 12A, 2A is arranged at least one of the protruding portion 14, 21 and the facing surface of the die-cast inner rotor 2 or the die-cast housing 1 relative to the protruding portion 14, 21. However, the seal member SE and the biasing member SP are arranged between the protruding portion 14, 21 and the facing surface of the die-cast inner rotor 2 or the die-cast housing 1 relative to the protruding portion 14, 21; thereby, the liquid-sealed condition in the clearance defined between the protruding portion 14, 21 and the facing surface of the die-cast inner rotor 2 or the die-cast housing 1 relative to the protruding portion 14, 21 may be secured while not being affected by the inclined surface 12A, 2A.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control apparatus, comprising:

a drive-side rotary member rotating in synchronization with a rotation of a crank shaft;

a driven-side rotary member arranged coaxially with the drive-side rotary member and rotating in synchronization with a rotation of a cam shaft for opening and closing a valve of an internal combustion engine;

a partition portion arranged at least one of the drive-side rotary member and the driven-side rotary member to partition a fluid pressure chamber, which is formed by the drive-side rotary member and the driven-side rotary member, into an advanced angle chamber and a retarded angle chamber a seal member arranged at a portion of the partition portion, which faces the other one of the drive-side rotary member and the driven-side rotary member, the seal member avoiding a hydraulic fluid from leaking between the advanced angle chamber and the retarded angle chamber due to a relative rotation between the drive-side rotary member and the driven-side rotary member; and a biasing member elastically deformed to exert a biasing force to bias the seal member from the partition portion arranged at the one of the drive-side rotary member and the driven-side rotary member toward the other one of the drive-side rotary member and the driven-side rotary member, wherein at least one of the drive-side rotary member and the driven-side rotary member is manufactured by a die-casting process, and wherein at least one of the partition portion and a facing surface of the other one of the die-casting drive-side rotary member and the die-casting driven-side rotary member facing the partition portion is defined by an inclined surface of a tapered portion.

2. The variable valve timing control apparatus according to claim 1, wherein the seal member includes facing surfaces facing the drive-side rotary member and the driven-side rotary member, and at least one of the facing surfaces of the seal member is formed to be in parallel with the inclined surface of the tapered portion.

3. The variable valve timing control apparatus according to claim 2, wherein a contact portion extending in a direction of an axis of the cam shaft and contacting the seal member is arranged on at least one of the drive-side rotary member and the driven-side rotary member so as to allow the seal member to exert the biasing force in a direction in which the tapered portion gradually tapers.

4. The variable valve timing control apparatus according to claim 3, wherein a chamfered portion or a groove is formed at an outer circumferential surface of the seal member arranged at a facing portion of the partition portion relative to the drive-side rotary member, and the outer circumferential surface of the seal member is located radially outwardly of the driven-side rotary member.

5. The variable valve timing control apparatus according to claim 4, wherein the chamfered portion or the groove is formed on a corner portion of the outer circumferential surface of the seal member, and the corner portion of the outer circumferential surface of the seal member is located radially outwardly of the driven-side rotary member so as to extend along a rotating direction of the drive-side rotary member.

6. The variable valve timing control apparatus according to claim 2, wherein a chamfered portion or a groove is formed at an outer circumferential surface of the seal member arranged at a facing portion of the partition portion relative to the drive-side rotary member, and the outer circumferential surface of the seal member is located radially outwardly of the driven-side rotary member.

7. The variable valve timing control apparatus according to claim 6, wherein the chamfered portion or the groove is formed on a corner portion of the outer circumferential surface of the seal member, and the corner portion of the outer circumferential surface of the seal member is located radially outwardly of the driven-side rotary member so as to extend along a rotating direction of the drive-side rotary member.

8. The variable valve timing control apparatus according to claim 1, wherein a contact portion extending in a direction of an axis of the cam shaft and contacting the seal member is arranged on at least one of the drive-side rotary member and the driven-side rotary member so as to allow the seal member to exert the biasing force in a direction in which the tapered portion gradually tapers.

9. The variable valve timing control apparatus according to claim 8, wherein a chamfered portion or a groove is formed at an outer circumferential surface of the seal member arranged at a facing portion of the partition portion relative to the drive-side rotary member, and the outer circumferential surface of the seal member is located radially outwardly of the driven-side rotary member.

10. The variable valve timing control apparatus according to claim 9, wherein the chamfered portion or the groove is formed on a corner portion of the outer circumferential surface of the seal member, and the corner portion of the outer circumferential surface of the seal member is located radially outwardly of the driven-side rotary member so as to extend along a rotating direction of the drive-side rotary member.

11. The variable valve timing control apparatus according to claim 1, wherein one of inclined surfaces of tapered portions arranged at the drive-side rotary member and the driven-side rotary member, respectively, and the other of the inclined surfaces of the tapered portions arranged at the drive-side rotary member and the driven-side rotary member, respectively, face each other and are in parallel with each other, and wherein the facing surface of the other one of the drive-side rotary member and the driven-side rotary member relative to the partition portion and the facing portion of the partition portion relative to the one of the drive-side rotary member and the driven-side rotary member are defined by the inclined surfaces of the tapered portions.

12. The variable valve timing control apparatus according to claim 11, wherein a chamfered portion or a groove is formed at an outer circumferential surface of the seal member arranged at a facing portion of the partition portion relative to the drive-side rotary member, and the outer circumferential surface of the seal member is located radially outwardly of the driven-side rotary member.

13. The variable valve timing control apparatus according to claim 12, wherein the chamfered portion or the groove is formed on a corner portion of the outer circumferential surface of the seal member, and the corner portion of the outer circumferential surface of the seal member is located radially outwardly of the driven-side rotary member so as to extend along a rotating direction of the drive-side rotary member.

14. The variable valve timing control apparatus according to claim 1, wherein a chamfered portion or a groove is formed at an outer circumferential surface of the seal member arranged at a facing portion of the partition portion relative to the drive-side rotary member, and the outer circumferential surface of the seal member is located radially outwardly of the driven-side rotary member.

15. The variable valve timing control apparatus according to claim 14, wherein the chamfered portion or the groove is formed on a corner portion of the outer circumferential surface of the seal member, and the corner portion of the outer circumferential surface of the seal member is located radially outwardly of the driven-side rotary member so as to extend along a rotating direction of the drive-side rotary member.

16. A variable valve timing control apparatus, comprising:

a drive-side rotary member rotating in synchronization with a rotation of a crank shaft;

a driven-side rotary member arranged coaxially with the drive-side rotary member and rotating in synchronization with a rotation of a cam shaft for opening and closing a valve of an internal combustion engine;

a partition portion arranged at least one of the drive-side rotary member and the driven-side rotary member to partition a fluid pressure chamber, which is formed by the drive-side rotary member and the driven-side rotary member, into an advanced angle chamber and a retarded angle chamber;

a seal member arranged at a portion of the partition portion, which faces the other one of the drive-side rotary member and the driven-side rotary member, the seal member avoiding a hydraulic fluid from leaking between the advanced angle chamber and the retarded angle chamber due to a relative rotation between the drive-side rotary member and the driven-side rotary member; and a biasing member elastically deformed to exert a biasing force to bias the seal member from the partition portion arranged at the one of the drive-side rotary member and the driven-side rotary member toward the other one of the drive-side rotary member and the driven-side rotary member, wherein at least one of the partition portion and a facing surface of the other one of the drive-side rotary member and the driven-side rotary member facing the partition portion is defined by an inclined surface of a tapered portion.

17. The variable valve timing control apparatus according to claim 16, wherein at least one of the drive-side rotary member and the driven-side rotary member is manufactured by a die-casting process, and wherein at least one of the partition portion and the facing surface of the other one of the die-cast drive-side rotary member and the die-cast driven-side rotary member facing the partition portion is defined by the inclined surface.

* * * * *